US009514615B2

(12) United States Patent
Bramble

(10) Patent No.: US 9,514,615 B2
(45) Date of Patent: Dec. 6, 2016

(54) SLIDING JACKPOT PROBABILITIES

(75) Inventor: Paul Francis Bramble, Artarmon (AU)

(73) Assignee: Aristocrat Technologies Australia Pty Limited, North Ryde, NSW (AU)

( * ) Notice: Subject to any disclaimer, the term of this patent is extended or adjusted under 35 U.S.C. 154(b) by 117 days.

(21) Appl. No.: 13/102,297

(22) Filed: May 6, 2011

(65) Prior Publication Data

US 2011/0275433 A1 Nov. 10, 2011

(30) Foreign Application Priority Data

May 6, 2010 (AU) ..... 2010901989

(51) Int. Cl.
*G07F 17/32* (2006.01)
*G07F 17/34* (2006.01)

(52) U.S. Cl.
CPC ..... *G07F 17/34* (2013.01); *G07F 17/3267* (2013.01)

(58) Field of Classification Search
USPC ..... 463/16, 20, 25, 31
See application file for complete search history.

(56) References Cited

U.S. PATENT DOCUMENTS 6,155,925 A * 12/2000 Giobbi ..... G07F 17/3244 273/138.1
6,506,116 B1 1/2003 Sunaga et al.
6,569,016 B1 * 5/2003 Baerlocher ..... 463/16
6,783,457 B2 * 8/2004 Hughs-Baird et al. ..... 463/20
6,852,027 B2 2/2005 Kaminkow et al.
6,929,264 B2 8/2005 Huard et al.
6,988,732 B2 1/2006 Vancura
7,073,793 B2 7/2006 Vancura
7,108,603 B2 9/2006 Olive
7,234,700 B2 6/2007 Vancura
7,374,482 B2 5/2008 Ghaly
7,575,515 B2 * 8/2009 Rodgers et al. ..... 463/20
8,092,299 B2 * 1/2012 Cohen et al. ..... 463/20
2002/0045475 A1 * 4/2002 Glavich et al. ..... 463/20
2003/0036423 A1 * 2/2003 Vancura ..... 463/20
2003/0040357 A1 * 2/2003 Baerlocher ..... 463/20
2003/0060258 A1 * 3/2003 Coleman et al. ..... 463/16
2003/0137110 A1 7/2003 Huard et al.
2003/0216165 A1 * 11/2003 Singer et al. ..... 463/20
(Continued)

FOREIGN PATENT DOCUMENTS

AU 200185540 B2 1/2002
AU 2003100284 B4 7/2003
(Continued)

*Primary Examiner* — Tramar Harper
(74) *Attorney, Agent, or Firm* — Armstrong Teasdale LLP

(57) ABSTRACT

A game controller operable to control play of a game. The game controller includes a configuration module, a wager determination module and a trigger module. The configuration module configures a secondary event trigger having a hit rate which is fixed over a plurality of games. The wager determination module determines an amount wagered for play of one of the games. The trigger module triggers a secondary game event in which a higher value prize and lower value prize are each eligible to be awarded upon determining the trigger in the game, such that a probability of awarding the higher value prize increases with the amount wagered in the game, while the probability of awarding the lower value prize decreases.

21 Claims, 7 Drawing Sheets

(56) References Cited

U.S. PATENT DOCUMENTS

| | | | | |
|---|---|---|---|---|
| 2003/0228901 | A1* | 12/2003 | Walker et al. | 463/25 |
| 2003/0232638 | A1 | 12/2003 | Luciano, Jr. | |
| 2004/0053669 | A1* | 3/2004 | Gerrard et al. | 463/20 |
| 2004/0067790 | A1* | 4/2004 | Peterson et al. | 463/20 |
| 2004/0185932 | A1 | 9/2004 | Lombardo | |
| 2004/0242316 | A1* | 12/2004 | Oles et al. | 463/20 |
| 2005/0003878 | A1 | 1/2005 | Updike | |
| 2005/0064932 | A1 | 3/2005 | Cannon | |
| 2005/0096121 | A1* | 5/2005 | Gilliland et al. | 463/20 |
| 2005/0119047 | A1 | 6/2005 | Olive | |
| 2005/0159211 | A1* | 7/2005 | Englman | 463/25 |
| 2005/0176488 | A1 | 8/2005 | Olive | |
| 2005/0227753 | A1 | 10/2005 | Luciano, Jr. | |
| 2005/0282609 | A1 | 12/2005 | Olive | |
| 2006/0030399 | A1* | 2/2006 | Baerlocher | 463/20 |
| 2006/0036482 | A1 | 2/2006 | Huang et al. | |
| 2006/0148558 | A1 | 7/2006 | Olive | |
| 2006/0166730 | A1 | 7/2006 | Olive | |
| 2006/0205483 | A1 | 9/2006 | Meyer et al. | |
| 2006/0223614 | A1 | 10/2006 | Olive | |
| 2006/0277142 | A1 | 12/2006 | McGeorge | |
| 2007/0054728 | A1 | 3/2007 | Hood | |
| 2007/0060252 | A1 | 3/2007 | Taylor | |
| 2007/0072668 | A1* | 3/2007 | Hein et al. | 463/16 |
| 2007/0111785 | A1 | 5/2007 | Olive | |
| 2007/0117624 | A1 | 5/2007 | Amaitis et al. | |
| 2007/0123336 | A1 | 5/2007 | Amaitis et al. | |
| 2007/0129138 | A1 | 6/2007 | Amaitis et al. | |
| 2008/0026840 | A1* | 1/2008 | Souza et al. | 463/31 |
| 2008/0227537 | A1* | 9/2008 | Hall | 463/25 |
| 2008/0248867 | A1* | 10/2008 | Englman et al. | 463/25 |
| 2008/0287185 | A1 | 11/2008 | Yoseloff et al. | |
| 2009/0082097 | A1 | 3/2009 | Lombardo | |
| 2009/0124353 | A1* | 5/2009 | Collette et al. | 463/25 |
| 2011/0065490 | A1* | 3/2011 | Lutnick | 463/16 |
| 2011/0218027 | A1* | 9/2011 | Manz et al. | 463/19 |
| 2011/0306405 | A9* | 12/2011 | Walker et al. | 463/25 |

FOREIGN PATENT DOCUMENTS

| | | | |
|---|---|---|---|
| AU | 2003201574 | B2 | 9/2003 |
| AU | 2008201891 | A1 | 12/2008 |
| WO | 03061788 | A1 | 7/2003 |

* cited by examiner

Figure 8
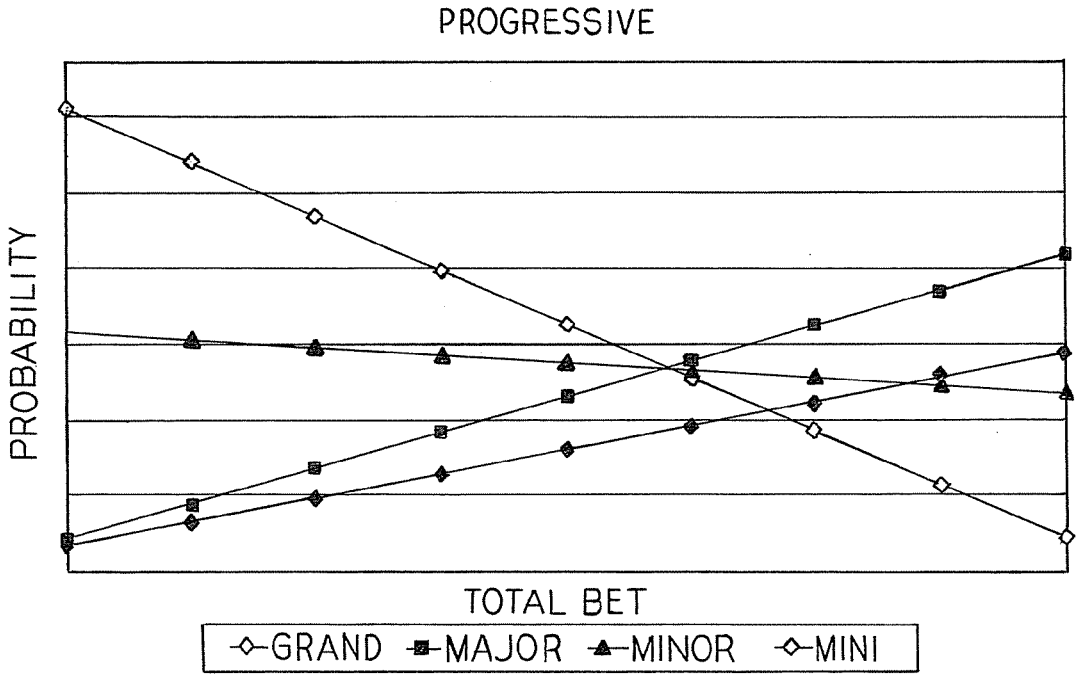
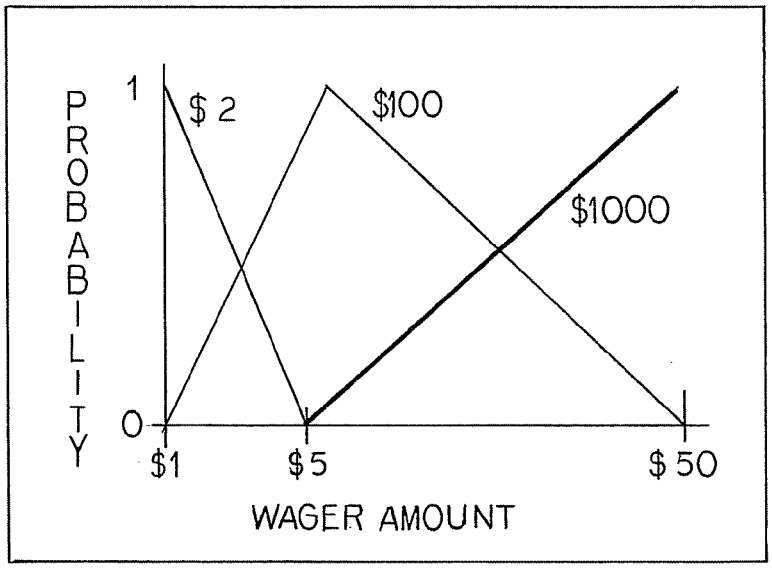
Figure 9

SLIDING JACKPOT PROBABILITIES

RELATED APPLICATIONS

This application claims priority to Australian Patent Application No. 2010901989 having a filing date of May 6, 2010, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to a gaming system and a method of gaming, and particularly, but not exclusively, to a gaming system, controller and method for awarding jackpot prizes.

It is known to provide a gaming system which comprises a game controller arranged to randomly display several symbols from a predetermined set of symbols and to determine a game outcome such as a game win based on the displayed symbols. Such gaming systems may commonly be implemented as a stepping machine provided with reels with each reel carrying several symbols of the set, or a video machine wherein selected symbols are displayed on virtual reels on a graphical display device. Win outcomes can occur based on symbols appearing in one or more horizontal lines, diagonal lines, or any other predetermined way.

It is also known to award high paying prizes, referred to as jackpot prizes, which may be funded from a prize pool. Typically, a portion of a gaming machine's turnover is forwarded to a jackpot prize controller which maintains the prize pool.

One common way of awarding a jackpot prize is based on determining a certain symbol or symbol combination in a game outcome, often referred to as a symbol driven jackpot. However, a problem with this sort of jackpot awarding technique is that the probability of being awarded the jackpot prize (or simply qualifying for the prize) is not tied to the amount wagered by the player and thus does not meet regulatory gaming requirements for many jurisdictions. To overcome this problem, some gaming systems have been modified so as to increase the number of jackpot trigger symbols available for selection in the game, in proportion to the wagered amount. However, the problem with such modified jackpot awarding techniques is that players wagering small amounts are not awarded with jackpots as often as players wagering larger amounts resulting in those players losing interest in the game.

BRIEF SUMMARY OF THE INVENTION

In accordance with a first aspect, the present invention provides a method of controlling a secondary game event in a wager based game, the method comprising the steps of:

configuring a secondary event trigger having a hit rate which is fixed over a plurality of games;

determining an amount wagered for play of one of the games; and upon determining the secondary game event trigger during the game, initiating the secondary game event in which a higher value prize and lower value prize are each eligible to be awarded, such that a probability of being awarded the higher value prize increases with the amount wagered in the game, while the probability of achieving the lower value prize decreases.

In an embodiment the secondary event trigger is a symbol driven trigger occurring during play of the game.

In an embodiment the prizes are jackpot prizes funded from a jackpot prize pool.

In an embodiment the method comprises the further step of allocating a percentage of each wager to the jackpot prize pool.

In an embodiment the method comprises the further step of setting the probabilities such that an average jackpot return over the plurality of games is substantially constant for a range of wager amounts.

In an embodiment the method comprises the further step of determining which of the higher or lower value prize to award based on the wagered amount and awarding the determined prize.

In an embodiment the method further comprises providing a plurality of distinct higher and lower value prizes, a relative probability increase for each prize with respect to the wager amount being dependent on a required rate of return.

In an embodiment the method comprises the further step of awarding a combination of the plurality of distinct prizes to achieve the required rate of return.

In an embodiment the step of determining a wager amount comprises determining an average wager amount over a number of games since a last jackpot was awarded such that the relative probabilities are determined based on the average wager amount.

In accordance with a second aspect there is provided a game controller operable to control play of a game, the game controller comprising:

a configuration module arranged to configure a secondary event trigger having a hit rate which is fixed over a plurality of games;

a wager determination module arranged to determine an amount wagered for play of one of the games;

trigger module arranged to trigger a secondary game event in which a higher value prize and lower value prize are each eligible to be awarded upon determining the secondary event trigger during the game, such that a probability of awarding the higher value prize increases with the amount wagered in the game, while the probability of awarding the lower value prize decreases.

In an embodiment the secondary event trigger is a symbol driven trigger occurring during play of the base game.

In an embodiment the prizes are jackpot prizes funded from a jackpot prize pool.

In an embodiment a percentage of each wager is allocated to the jackpot prize pool.

In an embodiment the probabilities are set such that an average jackpot return over the plurality of games is substantially constant for a range of wager amounts.

In an embodiment the prizes comprise a plurality of distinct higher and lower value prizes, a relative increase for each distinct prize with respect to the wager amount being dependent on a required rate of return.

In an embodiment the controller further comprises an award module operable to award a combination of the plurality of distinct prizes to achieve the required rate of return.

In an embodiment the determined wager amount comprises an average wager amount over a number of games since a last jackpot was awarded such that the relative probabilities are determined based on the average wager amount.

In accordance with a third aspect the present invention provides a method of controlling a secondary game event in a wager based game, the method comprising the steps of:

determining an amount wagered for play of one of the games; and upon determining a particular trigger during play of the game, initiating the secondary game event in which a higher value prize and lower value prize are each eligible to be awarded, such that a probability of being awarded the higher value prize increases with the amount wagered in the game, while the probability of achieving the lower value prize decreases and such that a rate at which the secondary game event is triggered is independent of the amount wagered for play of the game.

In an embodiment the rate at which the secondary game event is triggered is fixed.

In accordance with a fourth aspect the present invention provides a method of controlling a secondary game event in a wager based game, the method comprising the steps of:

determining an amount wagered for play of one of the games; and upon determining a particular trigger during play of the game, initiating the secondary game event in which a higher value prize and lower value prize are each eligible to be awarded, such that a probability of being awarded the higher value prize increases with the amount wagered in the game, while the probability of achieving the lower value prize decreases and such that the secondary game event is triggered once on average for every n games, where n is greater than two.

In accordance with a fifth aspect there is provided a game controller operable to control play of a game, the game controller comprising:

a wager determination module arranged to determine an amount wagered for play of one of the games;

trigger module arranged to trigger a secondary game event in which a higher value prize and lower value prize are each eligible to be awarded upon determining a secondary event trigger during the game, such that a probability of awarding the higher value prize increases with the amount wagered in the game, while the probability of awarding the lower value prize decreases and wherein a hit rate for the secondary game event trigger is independent of the amount wagered.

In accordance with a sixth aspect the present invention provides a gaming system comprising a game controller in accordance with the second or fifth aspects and at least one gaming device providing a display arranged to display play of the game.

In accordance with a seventh aspect the present invention provides a computer program comprising instructions for controlling a game controller in accordance with the second aspect or a method in accordance with the first aspect.

In accordance with an eighth aspect the present invention provides a tangible computer readable medium providing a computer program in accordance with the seventh aspect.

BRIEF DESCRIPTION OF SEVERAL VIEWS OF THE DRAWINGS

Features and advantages of the present invention will become apparent from the following description of embodiments thereof, by way of example only, with reference to the accompanying drawings, in which:

FIGS. 8 & 9 are example game payout tables in accordance with embodiments of the present invention.

DETAILED DESCRIPTION OF THE INVENTION

In an embodiment there is provided a game controller operable to control play of a game on a gaming device. The game controller comprises a configuration module arranged to configure a secondary event trigger having a hit rate which is fixed over a plurality of games; a wager determination module arranged to determine an amount wagered for play of one of the games. A trigger module, also implemented by the game controller, is arranged to initiate a secondary game event, in which a higher value jackpot and lower value jackpot are each eligible to be awarded, upon detecting the secondary event trigger in the game. The secondary game event is configured such that a probability of awarding the higher jackpot increases with the amount wagered, while the probability of awarding the lower value jackpot decreases. In this manner, the game controller is operable to provide a jackpot prize awarding technique which triggers jackpots at the same frequency irrespective of the amount wagered, but which may still provide an average jackpot return which is related to the wagered amount.

General Construction of a Gaming System

The gaming system can take a number of different forms. In a first form, a stand-alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Figure 1:
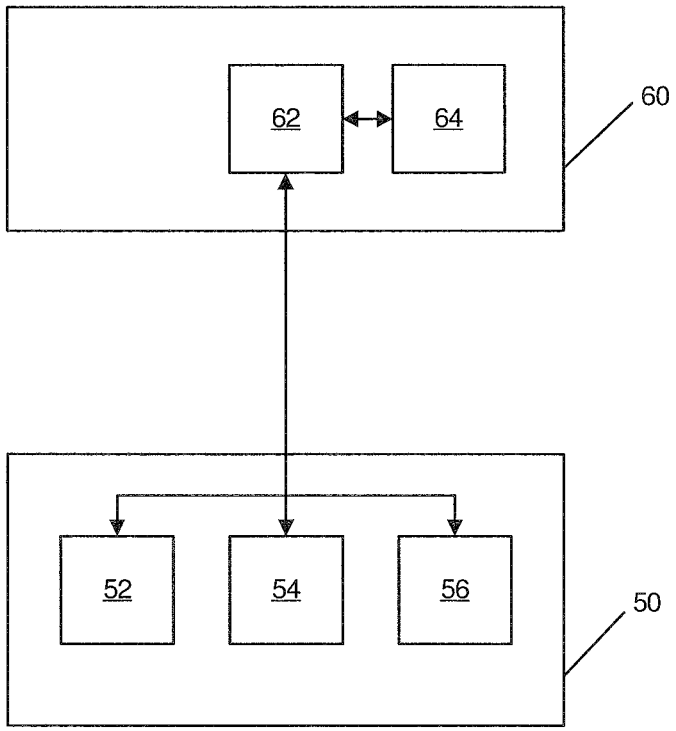
FIG. 1 is a schematic block diagram of core components of a gaming system in accordance with an embodiment of the present invention.

Irrespective of the form, the gaming system comprises several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions and play the game.

Components of the player interface may vary from embodiment to embodiment but will typically include a credit mechanism 52 to enable a player to input credits and receive payouts, one or more displays 54, a game play mechanism 56 that enables a player to input game play instructions (e.g. to place bets), and one or more speakers 58.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
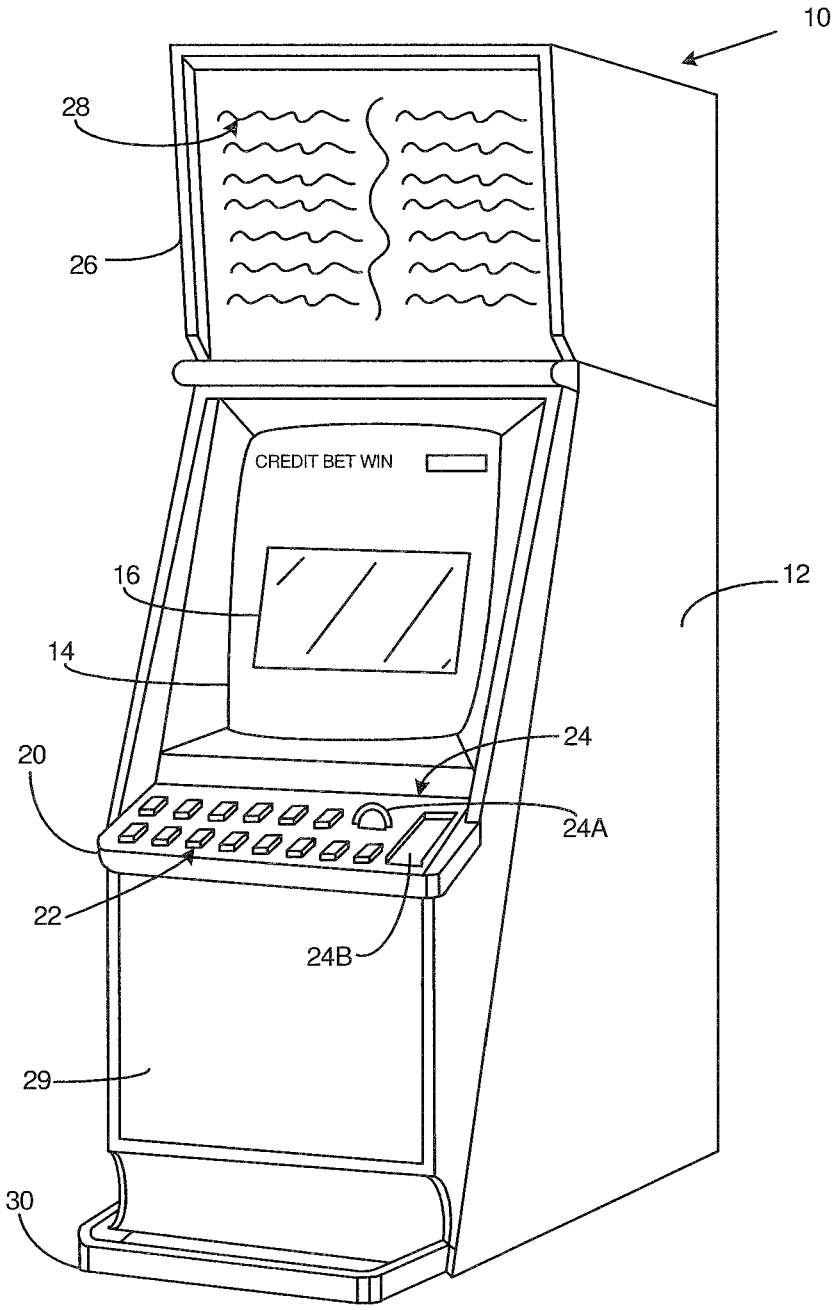
FIG. 2 is a diagrammatic representation of a gaming system in accordance with an embodiment of the present invention with the gaming system implemented in the form of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. A player marketing module (not shown) having a reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
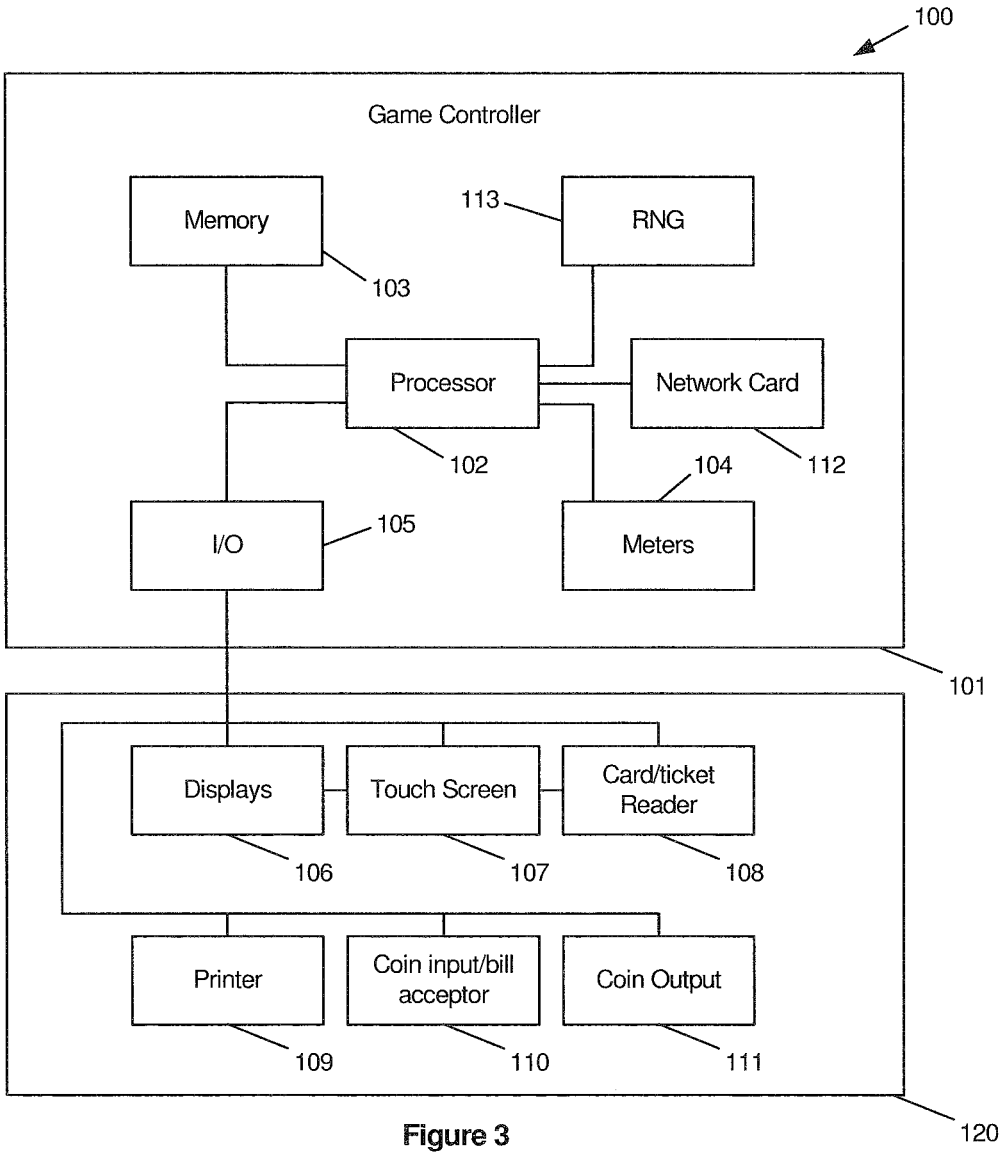
FIG. 3 is a schematic block diagram of operative components of the gaming machine shown in FIG. 2.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 comprise one or more displays 106, a touch screen and/or buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

Figure 4:
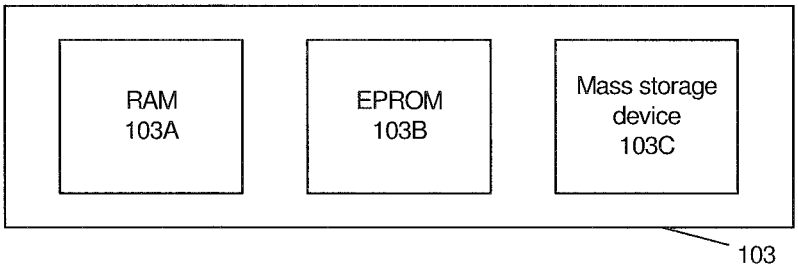
FIG. 4 is a schematic block diagram of components of a memory of the gaming machine shown in FIG. 2.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
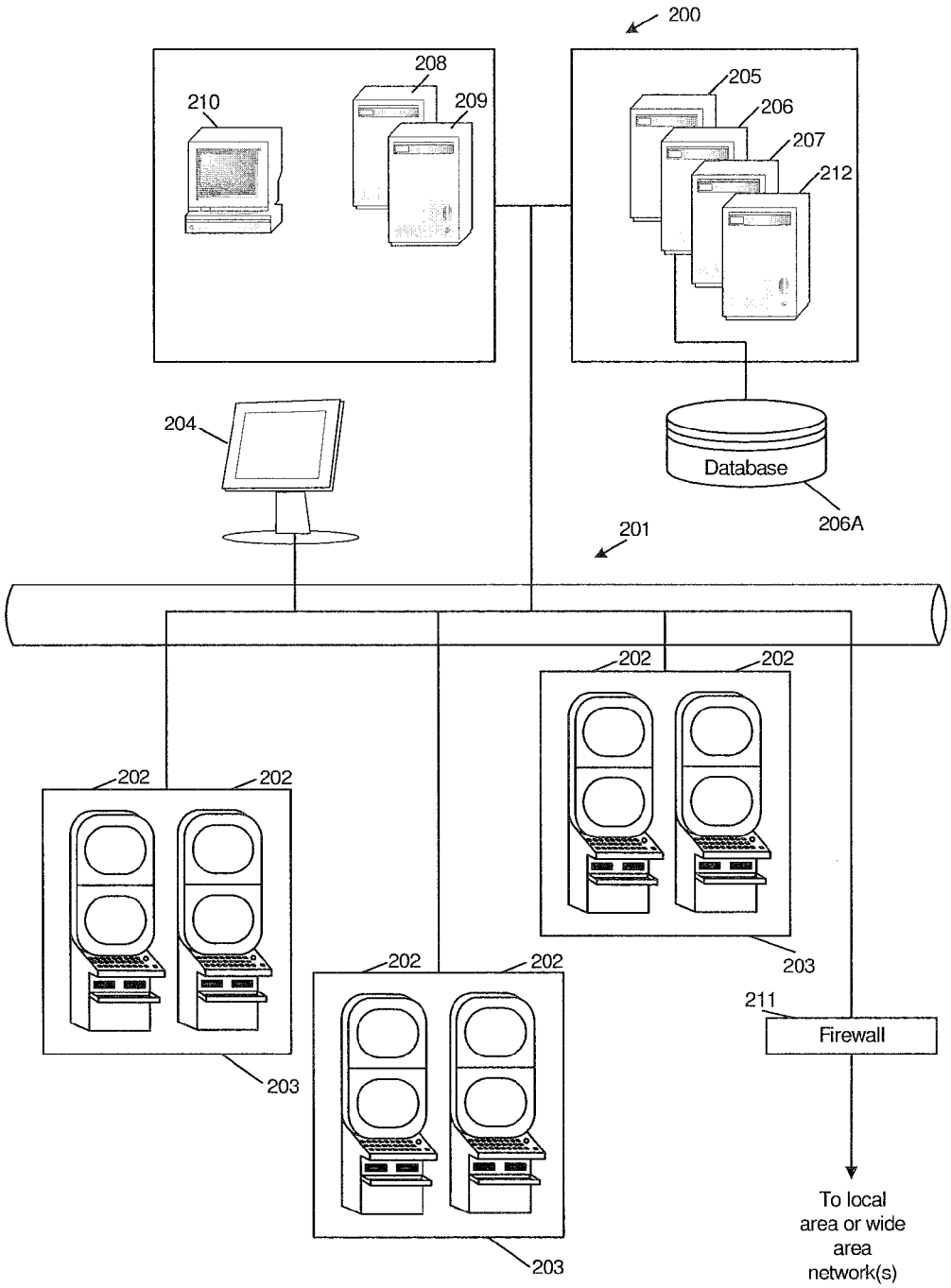
FIG. 5 is a schematic diagram of a gaming system in accordance with an alternative embodiment of the present invention with the gaming system implemented over a network.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Persons skilled in the art will also appreciate that the method of the preferred embodiment could be embodied in program code. The program code could be supplied in a number of ways, for example on a computer readable medium, such as a disc or a memory (for example, that could replace part of memory 103) or as a data signal (for example, by downloading it from a server).

Embodiments may be implemented in relation to a spinning reel type game. Gaming systems for implementing games that involve a display of spinning reels as part of the display of the outcome of a game have either a video display or a mechanical display, these later machines most usually being "stepper" machines which have a separate motor for each reel. However, persons skilled in the art will appreciate that the invention can be implemented in respect of other forms of games, including; card games; ball draw games (e.g. bingo or keno); dice games; and pin and ball games.

In some implementations the game controllers of such gaming machines select symbols by employing a stop determining function that randomly determines the stop position for each reel. For example, if there are five reels, each having twenty symbols, the stop determining function might determine that the stop positions are positions: 3, 13, 7, 9 and 17. The spinning of the reels is then controlled so that each symbol comes to a stop in the same row, typically a predetermined row in a "window" visible to the player on the display that which corresponds to a player playing a single win line. When a reel stops, the symbols will be in one of a plurality of possible symbol positions for that reel relative to the stop position.

Spinning reel type games typically allow a player to select how many win lines of a plurality of win lines they will play in each game—i.e. a minimum of one win line up to the maximum number of win lines allowed by the game. Persons, skilled in the art, will appreciate that in other embodiments, the player may select a number of reels to play. Each win line is formed by a set of symbol positions consisting of one symbol position from each reel. That is, a predetermined symbol position of each reel is assigned to a win line. The symbol positions that constitute each of the win lines are usually advertised to the player by markings on the display or diagrams showing the symbol positions that correspond to each win line. Some of the win lines will be horizontal or diagonal lines. Typically, the win lines will be constituted by symbol positions in the visible window. A game outcome is determined based on the symbols on the win lines and a prize table that specifies awards.

More Detail of the Game Controller

Figure 6:
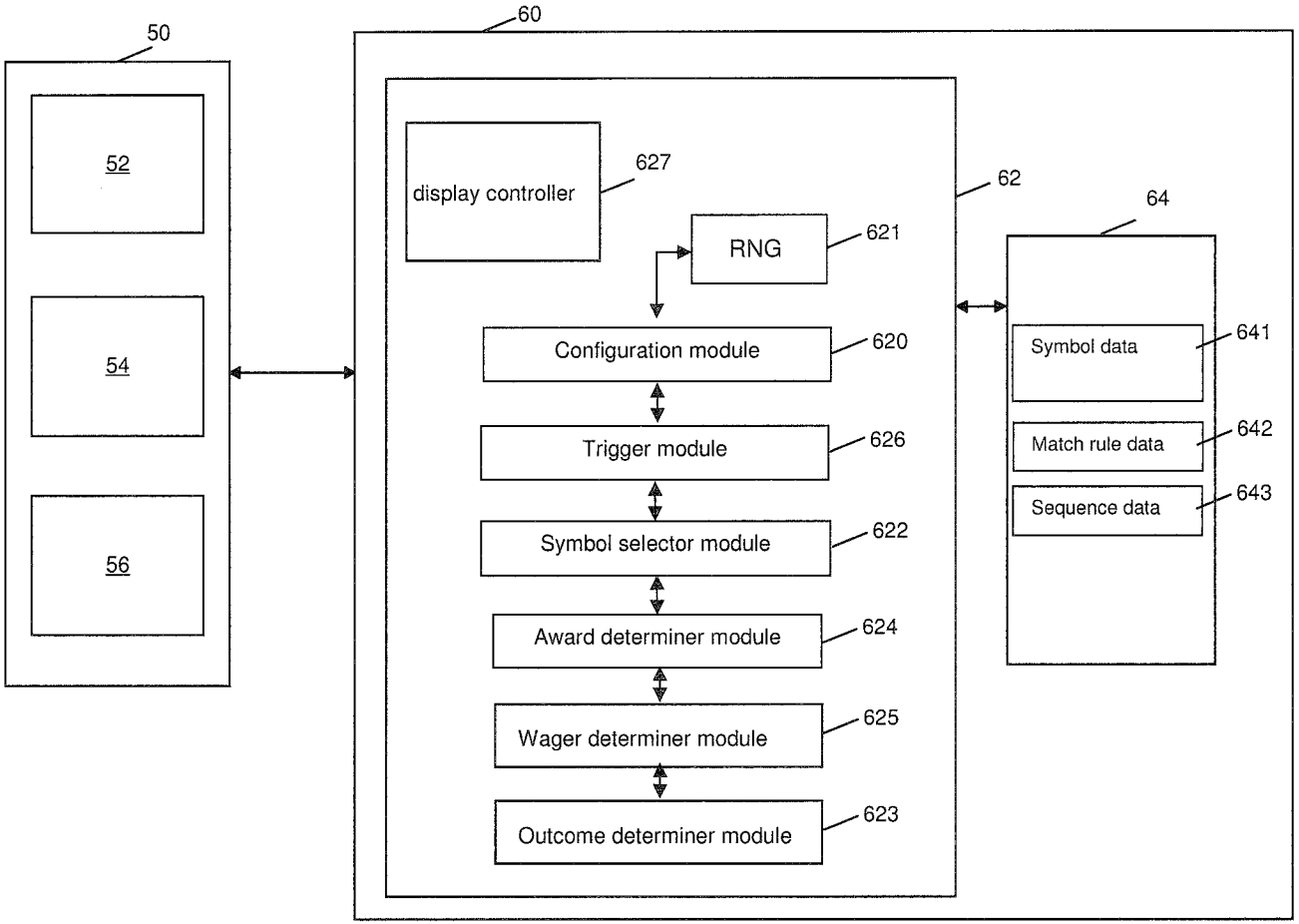
FIG. 6 is a schematic diagram of functional components of a gaming system in accordance with an embodiment of the present invention.
Figure 7:
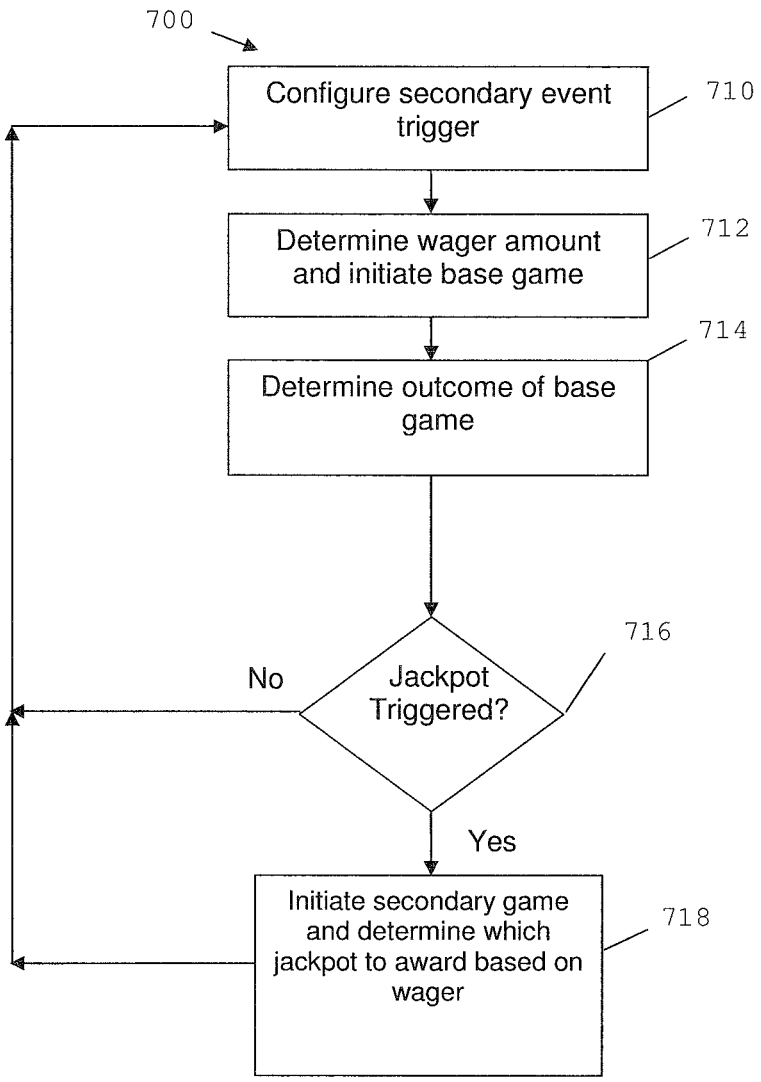
FIG. 7 is a flow diagram illustrating operation of a gaming system in accordance with an embodiment of the present invention.

The game controller 60 of an embodiment is shown in more detail in FIG. 6. As described in the preceding paragraphs, embodiments of the present invention are operable to provide a jackpot prize awarding technique which has an average return that is tied to an amount wagered by a player in the game, but which is triggered at a rate which is independent of the wagered amount. According to a specific embodiment, this is achieved by awarding distinct jackpots of different prize value in a secondary event (such as a bonus game) triggered during play of a base game, such that the probability of being awarded a higher paying jackpot prize in the secondary event increases as a function of the amount wagered in the base game, while the probability of being awarded a lower paying jackpot prize decreases. In other words, the jackpot may be treated much like a feature event whereby the jackpot is won at a fixed rate independent of the wager but whereby the final prize value is related to the wager. For simplicity, only those modules needed to carry out such embodiments are illustrated in FIG. 6. Other standard and/or non-standard modules may also be implemented for carrying out operation of normal and feature game play functionality.

It will be understood that the jackpot prizes may be funded from a jackpot prize pool that is implemented by the game controller 60, or by some remote jackpot controller (e.g. incorporated into the jackpot server 207, as previously described). The prize pool may be made up of contributions from a single gaming machine or from a collection of gaming machines that are each eligible to be awarded the jackpot prize. Alternatively, the jackpot prize may be some other major prize that is independent of machine contributions. Such variations are within the purview of the skilled person.

The game controller 60 includes a processor 62 which is arranged to control game play and determine a game outcome. It will be apparent that the processor 62 implements a number of modules, namely a configuration module 620, random number generator module (RNG) 621, symbol selector module 622, outcome determiner module 623, award determiner module 624, wager determination module 625, trigger module 626 and display controller module 627, based on data stored in memory 64. Persons skilled in the art will appreciate that not all modules need be implemented by processor 62. For example, the random number generator module 621 could be implemented by a separate circuit or by a random number generator server.

In the following description, embodiments will be described in the context of a wager based game having a plurality of reels (each carrying a plurality of symbols), which are spun to determine game outcomes. However, it will be understood that embodiments are equally applicable to non-reel based games including card games, dice games, numbered ball games, or indeed any type of game of chance where markers with different values/symbols are utilised.

During each game of the reel game, the wager determination module 625 of the game controller 60 determines an amount wagered by a player in the game (e.g. by selecting a button corresponding to the wager amount on the gaming machine which causes a signal to be sent to the game controller 60 to notify the game controller of the wager amount). The symbol selector 622 then selects symbols to be displayed in a reel window displaying a plurality of reels, based on symbol data 641 stored in memory 64, specifying the available symbols. The symbols to appear in the reel window are selected by the symbol selector 622 using a random number, or seed, obtained from the random number generator 621. The outcome determiner module 623 determines the game outcomes and their associated prizes based on the number of win lines the player is playing, the amount wagered and the resultant symbol combinations. In the presently described embodiment, certain game outcomes include secondary event triggers (hereafter "jackpot triggers") which are set by the configuration module 620 and which collectively have a fixed hit rate. That is, the rate at which the secondary event is triggered is fixed over a plurality of games irrespective of the amount wagered in the base game. For example, it may be decided to trigger the secondary game event once on average for every 100 games played. It will be understood that the actual hit rate selected can be any particular rate depending on the desired implementation. The jackpot trigger may be a symbol driven trigger such as a predetermined number or combination of special symbols appearing on a selected pay line, or alternatively appearing in any location within the reel window (referred to as a "scatter" trigger). The reel window and corresponding game outcomes are displayed on the display 54, under control of the display controller 627.

Responsive to determining that a jackpot trigger has occurred in the base game, the trigger module 626 is operable to either instantly award at least one of a plurality of distinct jackpot prizes, or trigger a secondary jackpot game in which the at least one distinct jackpot prizes is awarded. In the embodiments described herein, a secondary game is triggered upon detecting three scattered "X" symbols in the base game.

The determination as to which jackpot prize (or combination of jackpot prizes) to be awarded is based on the amount wagered, such that a probability of achieving a higher valued jackpot increases with the amount wagered, while the probability of achieving a lower valued jackpot decreases. In other words, for small bets a smaller jackpot is won more often, whereas for larger bets a larger jackpot is won more often. The aforementioned technique advantageously provides that the frequency of awarding jackpot prizes remains constant irrespective of the wagered amount, while at the same time rewarding players who wager larger amounts on the game with a greater chance at being awarded a higher paying jackpot.

The method 700 of the invention is summarised in FIG. 700. At step 710 a secondary game event trigger is set, the trigger having a hit rate which is fixed over a plurality of games. At step 712, a wager staked on the game is determined by the wager determination module 625. The controller 60 then carries out play of a base game and outcomes are determined by the outcome determiner module 623, as previously described (step 714). At step 716, upon determining that the secondary game event has been triggered, the trigger module 626 initiates a secondary game event in which a higher value prize (hereafter "major jackpot") and lower value prize (hereafter "minor jackpot") are each eligible to be awarded, such that a probability of being awarded the major jackpot increases with the amount wagered, while the probability of being awarded the minor jackpot decreases. At step 718, the award determiner 624 determines the total award payable to the player.

The aforementioned jackpot awarding technique can be described mathematically as follows, where the minor jackpot is referred to as "j" and the major jackpot as "J".

More detailed examples of embodiments will now be described. According to each embodiment, the game is in the form of a reel game.

Example 1

According to a first example embodiment, the reel game is configured such that three or more scatter symbols trigger a secondary game (hereafter "jackpot feature") at a rate T of 1 in 100, for an average return R of 10%. The minor jackpot is set at j=10 credits start-up, while the major jackpot start-up is set at J=100 credits. A player betting one credit may be awarded the minor jackpot j every jackpot feature for 10 credits at 1 in 100 credits bet, i.e. R=10%. However for a wager of 10 credits the player would be awarded J=100, also with a return of 10%. In an embodiment, there may be an option for a player to wager five credits in the game. In this case, the probability of being awarded the minor jackpot j of 10 credits may be set to 5/9, while the probability of winning a major jackpot is set to 4/9 to achieve the desired 10% return as follows.

$10\times5/9+100\times4/9=450/9=50$ credits.

It will be understood that the same calculations for achieving a desired return can be applied to any number of different wagers and for any number of distinct jackpot prizes, dependent only on the desired configuration.

Example 2

A combination of four distinct progressive jackpots may be awarded upon triggering of the jackpot feature. The four jackpots are divided into two lower paying jackpots having start-up values of $10 and $20 respectively, and two higher paying jackpots with start-ups of $1000 and $2000. The game offers a jackpot return of 15%, again triggered one in every hundred games and with wagers ranging from $1 to $100. According to this example embodiment, for $1 wagered the game mostly awards the lower paying jackpots for an average return of $15. When the player wagers $100 for 100 games (i.e. for a contribution of $10,000 turnover), the jackpots mostly consist of the higher paying progressive jackpots of $1000 (i.e. 10% return) and $2000 (20% return).

A pay scale for a jackpot feature game similar to that described above is shown in FIG. 8, with the jackpot probability plotted on the vertical axis and the total wager amount plotted on the horizontal axis. When the wager is low the MINOR and MINI jackpots (i.e. the lower paying jackpots) have a high probability of being awarded while the GRAND and MAJOR jackpots (i.e. the higher paying jackpots) have low probabilities. In contrast, when the wager is relatively large the MINOR and MINI jackpots have a lower probability of being awarded whereas the GRAND and MAJOR jackpots have higher probabilities.

It will be understood by persons skilled in the art that the adjustment in probability need not be smooth or continuous as the wager increases. For example, some jackpots could be available only for some wager intervals while still providing the same average jackpot return.

Example 3

According to the third example embodiment, a game offers a combination of jackpots to provide a 10% average jackpot return. The jackpot is triggered every 1 in 200 games with wagers ranging from $1 to $50. The jackpots are worth $20, $100 and $1000 respectively. With reference to FIG. 9, the probabilities are set such that a wager of $1 will only ever trigger the $20 jackpot. For wagers above $1 but less than $5, a distribution of $20 and $100 jackpots will be awarded, while a wager of $5 will always award the $100 jackpot. Wagers of between $5 and $50 will award either the $100 or $1000 jackpots and finally the major $1000 jackpot is awarded for $50 wagers only.

It is possible to combine the present invention with a traditional approach of making the feature trigger probability proportional to the bet. A wager increase of four credits could be accommodated with a two times better trigger rate and a 'probability slide', as described above, to accommodate the increased probability distribution in the jackpot feature.

The adjustment of the jackpot according to the wager may be done in part by repeating the jackpot. For example, a wager of six credits may have a three times better return due to the increased wager and be awarded twice over.

For each of the above described embodiments, the rate at which the secondary game event triggered was fixed over a particular number of games (e.g. triggered once on average every 100 games). However, in an alternative embodiment, the rate may be fixed for a particular time period, or the like.

Further it will be understood that the prizes awarded in the secondary event need not be jackpot prizes but instead could be any form of prize. For example, the higher paying prize could be an award of 20 free games while the lower paying prize could be an award of 10 free games. Such modifications are within the purview of the skilled person.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A method of controlling a secondary game event in a game on a gaming machine operable to award at least one of a plurality of prizes, the gaming machine comprising a credit input mechanism comprising at least one of a coin input mechanism, a bill collector, a card reader, and a ticket reader, receiving a credit input via the credit input mechanism to establish a credit balance, the credit balance being increasable and decreasable based at least on wagering activity; a gaming controller and a memory having containing data indicative of a predefined hit rate that is independent of a wagered amount, the method comprising:

causing, via the gaming controller, a secondary event trigger using the predefined hit rate;

receiving, via a user interface, a wager;

determining, via the gaming controller, an amount wagered for a play of the game from the credit balance;

decreasing the credit balance by the determined amount wagered;

sorting, via the gaming controller, the determined amount wagered into one of a plurality of ranges of amounts wagered;

detecting, via the gaming controller, an occurrence of the secondary event trigger during the game;

in response to detecting the occurrence of the secondary event trigger during the game, initiating, via the gaming controller, a secondary game event having the plurality of prizes available to be awarded; and restricting, via the gaming controller, the plurality of prizes available to be awarded in connection with the secondary game event based on the determined amount wagered, said restricting including awarding a particular one of the plurality of prizes based on a probability that depends on the one of the plurality of ranges into which the determined amount wagered is sorted, such that for a lowest of the plurality of ranges, the lowest of the plurality of prizes is more probable to be awarded, and for a highest of the plurality of ranges, the highest of the plurality of prizes is more probable to be awarded, wherein the probability of awarding the plurality of prizes is set such that an average return of the secondary game event is the same independent of the determined amount wagered.

2. A method of gaming in accordance with claim 1, wherein the hit rate is fixed over an indefinite number of games.

3. A method of gaming in accordance with claim 1, wherein the secondary event trigger is a symbol driven trigger occurring during play of the game.

4. A method of gaming in accordance with claim 1, wherein the plurality of prizes are jackpot prizes that are funded from a jackpot prize pool.

5. A method of gaming in accordance with claim 4, further comprising allocating a percentage of each wager to the jackpot prize pool.

6. A method of gaming in accordance with claim 1, further comprising determining which one of the highest and lowest prizes to award based on the determined amount wagered and the corresponding range, and awarding the determined prize.

7. A method of gaming in accordance with claim 1 further comprising defining a plurality of distinct higher and lower prizes, a relative increase for each prize with respect to the amount wagered being dependent on a required rate of return.

8. A method of gaming in accordance with claim 7, further comprising awarding a combination of the plurality of distinct prizes to achieve the required rate of return.

9. A method of gaming in accordance with claim 1, wherein determining the amount wagered comprises determining an average wager amount over a number of games since a last jackpot was awarded such that the relative probabilities are determined based on the average wager amount.

10. A game controller operable to control play of a plurality of games on a gaming machine a) operable to award at least one of a plurality of prizes, and b) having i) a credit input mechanism comprising at least one of a coin input mechanism, a bill collector, a card reader, and a ticket reader, the credit input mechanism configured to receive a credit input to establish a credit balance, the credit balance being increasable and decreasable based at least on wagering activity, for play of one of the plurality of games, ii) a user interface configured to receive a wager; and iii) a memory containing data indicative of a predefined hit rate that is independent of a wagered amount, and wherein each of the plurality of prizes corresponds to at least one range of a plurality of ranges of wager amounts, the game controller comprising:

a configuration module configured to configure a secondary event trigger using the predefined hit rate;

a wager determination module configured to determine an amount wagered for the play of one of the games from the credit balance, to sort the determined amount wagered into one of a plurality of ranges, and to decrease the credit balance by the determined amount wagered;

a trigger module configured to detect an occurrence of the secondary event trigger during one of the games, and in response to the occurrence of the secondary event trigger during one of the games, to trigger a secondary game event having the plurality of prizes available to be awarded; and an award determiner module configured to determine an award of a particular one of the plurality of prizes available to be awarded in connection with the secondary game event based on a probability that depends on the one of the plurality of ranges into which the determined amount wagered is sorted, such that for a lowest of the plurality of ranges, the lowest of the plurality of prizes is more probable to be awarded, and for a highest of the plurality of ranges, the highest of the plurality of prizes is more probable to be awarded, wherein the probability of awarding the plurality of prizes is set such that an average return of the secondary game event is the same independent of the determined amount wagered.

11. A game controller in accordance with claim 10, wherein the hit rate is fixed over an indefinite number of games.

12. A game controller in accordance with claim 10, wherein the secondary event trigger is a symbol driven trigger.

13. A game controller in accordance with claim 10, wherein the plurality of prizes are jackpot prizes funded from a jackpot prize pool.

14. A game controller in accordance with claim 13, wherein a percentage of each wager is allocated to the jackpot prize pool.

15. A game controller in accordance with claim 10, wherein the prizes comprise a plurality of distinct higher and lower value prizes in the respective range, a relative increase for each distinct prize with respect to the amount wagered being dependent on a required rate of return.

16. A game controller in accordance with claim 15, further comprising an award module operable to award a combination of the plurality of distinct prizes to achieve the required rate of return.

17. A game controller in accordance with claim 10, wherein the determined amount wagered is an average wager amount over a number of games since a last jackpot was awarded such that the relative probabilities are determined based on the average wager amount.

18. A gaming system operable to award at least one of a plurality of prizes and to play a secondary game event of a game, the gaming system comprising:

at least one gaming device providing a display configured to display play of the game;

a credit input mechanism comprising at least one of a coin input mechanism, a bill collector, a card reader, and a ticket reader, the credit wager input mechanism configured to receive a credit input to establish a credit balance, the credit balance being increasable and decreasable based at least on wagering activity, for a play of the game;

a user interface configured to receive a wager;

a memory containing data indicative of a predefined hit rate that is independent of a wagered amount;

a game controller configured to control the play of the game, the game controller comprising:

a configuration module configured to configure the secondary event trigger using the hit rate;

a wager determination module configured to determine the amount wagered for the play of one of the games, to sort the determined amount wagered into one of a plurality of ranges, and to decrease the credit balance by the determined amount wagered;

a trigger module configured to detect an occurrence of the secondary event trigger during one of the games, and in response to the occurrence of the secondary event trigger during one of the games, to trigger a secondary game event having the plurality of prizes available to be awarded; and an award determiner module configured to determine an award of a particular one of the plurality of prizes available to be awarded in connection with the secondary game event based on a probability that depends on the one of the plurality of ranges into which the determined amount wagered is sorted, such that for a lowest of the plurality of ranges, the lowest of the plurality of prizes is more probable to be awarded, and for a highest of the plurality of ranges, the highest of the plurality of prizes is more probable to be awarded, wherein the probability of awarding the plurality of prizes is set such that an average return of the secondary game event is the same independent of the determined amount wagered.

19. A method of controlling a secondary game event in a wager based game on a gaming machine operable to award at least one of a plurality of prizes, and having a credit input mechanism comprising at least one of a coin input mechanism, a bill collector, a card reader, and a ticket reader, receiving a credit input via the credit input mechanism to establish a credit balance, the credit balance being increasable and decreasable based at least on wagering activity;

receiving, via a user interface, a wager; a game controller and a memory containing data indicative of a predefined rate that is independent of a wager amount, the method comprising:

determining, via the gaming controller, an amount wagered for play of the game from the credit balance;

decreasing the credit balance by the determined amount wagered;

sorting, via the gaming controller, the determined amount wagered into one of a plurality of ranges;

detecting, via the gaming controller, an occurrence of a particular trigger during the game;

in response to detecting the occurrence of the particular trigger during play of the game, initiating, via the gaming controller, the secondary game event having the plurality of prizes available to be awarded; and determining, via the gaming controller, an award of a particular one of the plurality of prizes available to be awarded in connection with the secondary game event based on a probability that depends on the one of the plurality of ranges into which the determined amount wagered is sorted, such that for a lowest of the plurality of ranges, the lowest of the plurality of prizes is more probable to be awarded, and for a highest of the plurality of ranges, the highest of the plurality of prizes is more probable available to be awarded, wherein the probability of awarding the plurality of prizes is set such that an average return of the secondary game event is the same independent of the determined amount wagered.

20. A method of controlling a secondary game event in a game on a gaming machine operable to award at least one of a plurality of prizes, the gaming machine having a credit input mechanism comprising at least one of a coin input mechanism, a bill collector, a card reader, and a ticket reader, receiving a credit input via the credit input mechanism to establish a credit balance, the credit balance being increasable and decreasable based at least on wagering activity;

receiving, via a user interface, a wager; for play of the game, a game controller, and a memory containing data indicative of a predefined hit rate that is independent of a wagered amount, the method comprising:

determining, via the gaming controller, an amount wagered for the play of game from the credit balance;

decreasing the credit balance by the determined amount wagered;

sorting, via the gaming controller, the determined amount wagered into one of a plurality of ranges;

detecting, via the gaming controller, an occurrence of a secondary event trigger during the game;

in response to detecting the occurrence of the secondary event trigger during play of the game, initiating, via the gaming controller, the secondary game event having the plurality of prizes available to be awarded; and determining, via the gaming controller, a particular one of the plurality of prizes to be awarded in connection with the secondary game event based on a probability that depends on the one of the plurality of ranges into which the determined amount wagered is sorted, such that for a lowest of the plurality of ranges, the lowest of the plurality of prizes is more probable to be awarded, and for a highest of the plurality of ranges, the highest of the plurality of prizes is more probable to be awarded, wherein the probability of awarding the plurality of prizes is set such that an average return of the secondary game event is the same independent of the determined amount wagered.

21. A game controller operable to control play of a game on a gaming machine operable to award at least one of a plurality of prizes, the gaming machine comprising a credit input mechanism comprising at least one of a coin input mechanism, a bill collector, a card reader, and a ticket reader, the credit input mechanism configured to receive a credit input to establish a credit balance, the credit balance being increasable and decreasable based at least on wagering activity, a user interface configured to receive a wager, and a memory containing data indicative of a predefined hit rate that is independent of a wager amount, the game controller comprising:

a wager determination module configured to determine an amount wagered for play of the game from the credit balance, and to sort the determined amount wagered into one of a plurality of ranges, and to decrease the credit balance by the determined amount wagered;

a trigger module configured to detect an occurrence of a secondary event trigger during the game, and in response to an occurrence of a secondary event trigger during one of the games, to trigger a secondary game event having the plurality of prizes available to be awarded; and an award determiner module configured to determine an award of a particular one of the plurality of prizes available to be awarded in connection with the secondary game event based on a probability that depends on the one of the plurality of ranges into which the determined amount wagered is sorted, such that for a lowest of the plurality of ranges, the lowest of the plurality of prizes is more probable to be awarded, and for a highest of the plurality of ranges, the highest of the plurality of prizes is more probable to be awarded, wherein the probability of awarding the plurality of prizes is set such that an average return of the secondary game event is the same independent of the determined amount wagered.

* * * * *